US005450187A

United States Patent [19]

Pei et al.

[11] Patent Number: 5,450,187

[45] Date of Patent: Sep. 12, 1995

[54] ENVELOPE PROCESSING IN A LASER PRINTER FOR HIGHER RELIABILITY, USABILITY AND THROUGHPUT

[75] Inventors: Jack C. Pei, Rancho Palos Verdes; Glenn L. Hilt, Lawndale, both of Calif.

[73] Assignee: Xerox Corporation, Stamford, Conn.

[21] Appl. No.: 172,978

[22] Filed: Dec. 27, 1993

[51] Int. Cl.[6] ..... G03G 21/00

[52] U.S. Cl. ..... 355/311; 271/2

[58] Field of Search ..... 355/200, 271, 274, 282, 355/285, 289, 290, 308, 309, 311; 219/216; 271/2

[56] References Cited

U.S. PATENT DOCUMENTS

| | | | |
|---|---|---|---|
| 4,397,542 | 8/1983 | Brodesser | 355/311 X |
| 4,690,392 | 9/1987 | Coons, Jr. | 271/2 |
| 4,903,047 | 2/1990 | Hatanaka | 346/153.1 |
| 5,069,434 | 12/1991 | Sellers | 271/2 |
| 5,099,633 | 3/1992 | Gombault et al. | 53/411 |
| 5,130,752 | 7/1992 | Morishita et al. | 355/274 |
| 5,268,726 | 12/1993 | Oleksa et al. | 355/290 |

FOREIGN PATENT DOCUMENTS

| | | |
|---|---|---|
| 0027511 | 2/1993 | Japan . |
| 0094067 | 4/1993 | Japan . |

*Primary Examiner*—Robert Beatty
*Attorney, Agent, or Firm*—Robert Cunha

[57] ABSTRACT

A printer for printing on envelopes. The envelope is fed into the printer bottom edge first, the flap is opened with the glue side of the flap opposite the developing and fusing stations in the printer. This arrangement allows printing of addresses on the envelope body and flap, and also avoids contaminating the fuser and developing stations with glue.

2 Claims, 4 Drawing Sheets

ENVELOPE PROCESSING IN A LASER PRINTER FOR HIGHER RELIABILITY, USABILITY AND THROUGHPUT

BACKGROUND OF THE INVENTION

A method for enabling xerographic printing on envelopes, and more specifically for providing apparatus for envelopes to pass through the xerographic engine long edge first, flap trailing and with the glue side of the flap away from the photoreceptor.

It is well known that addresses can be printed on business size envelopes in xerographic printers, see U.S. Pat. Nos. 4,397,542, 5,069,434 and 5,099,633. The envelope is transported through the printer longitudinally, short edge first, so that the paper path nips, normally designed to handle 8½ by 11 inch paper sheets, in the case of #10 business envelopes will always be in contact with the 4 by 9½ inch envelope.

One problem associated with this process is that the flap adhesive may melt during the xerographic processing or be activated by moisture driven out of the paper, either sealing the envelope or contaminating the machine. This has been solved to some degree, see U.S. Pat. No. 4,898,323, by providing a high temperature adhesive. However, in the case where the envelope has a flap, the better solution to the contamination problem is to keep the flap closed.

Another problem associated with this arrangement is that the envelope is not perfectly symmetrical in construction from the top surface to the bottom and corner to corner. Furthermore, the envelope is processed through fuser roll nips that are balanced for minimizing the wrinkling of paper, and therefore are not balanced for minimizing the wrinkling of envelopes, and a certain amount of wrinkling of the envelope usually results as it passes through the roller nip of the roller fuser rolls. Also, an envelope may contain as many as four layers of paper from one side to the other which may result in an area on the envelope where the toner does not transfer properly.

There is thus a need in the industry for a printer process that will produce quality printing on envelopes at a high throughput rate.

SUMMARY OF THE INVENTION

This invention increases the throughput, prevents wrinkling and aids toner transfer by transporting the envelope through the printer long edge first, flap open and trailing and with the glue side of the flap away from the photoreceptor.

Throughput rate can be increased without changing the engine process speed since the envelope with the flap open is still about three inches shorter than the length of the envelope, so that the envelopes can be packed closer together as they are transported through the printer. However, with the flap open, the overall length of the envelope is still more than six inches, so that the nips do not have to be spaced much closer than would be normal for 8½ inch sheets of paper. Wrinkling is minimized since the envelope is more symmetrically balanced for reducing wrinkles when proceeding long edge first through the machine, has a much shorter distance to travel in the nip, and has one less layer of paper with the flap open. There are fewer toner drop outs since there is a maximum of three layers of paper in an opened envelope. Finally, machine contamination with the flap open can be reduced to a tolerable degree by choosing the proper adhesive.

Other advantages are that, after printing, the envelopes are open and ready for stuffing, and that print can easily be placed on the flap of the envelope for the return address without requiring a second pass through the printer, which results in less cost and less likelihood of increasing wrinkling further.

DETAILED DESCRIPTION OF THE INVENTION

Figure 1:
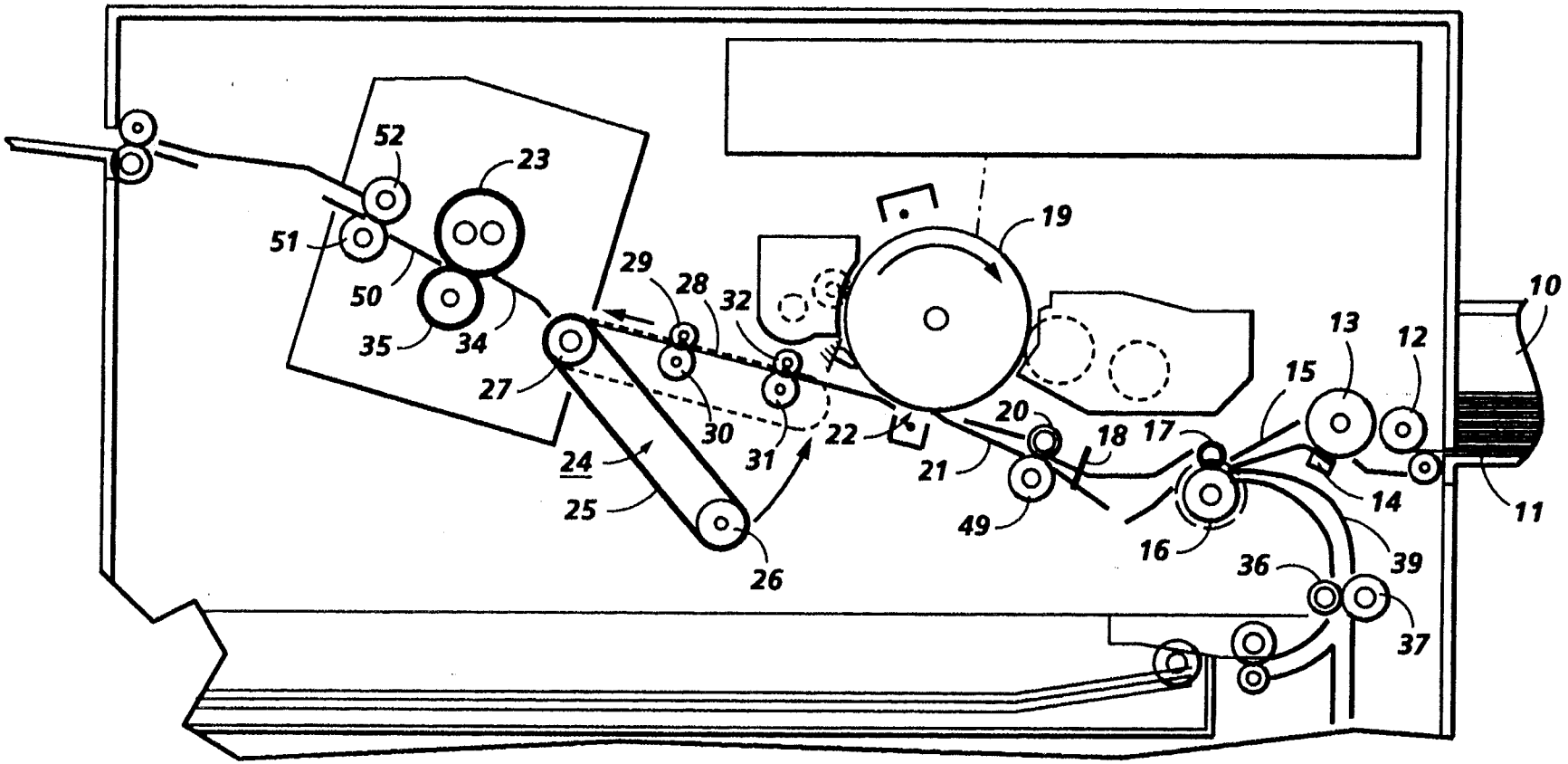
FIG. 1 is a detailed cross section of the printer.

The details of the envelope path are shown in FIG. 1. At the right, the envelopes are stored in the inserter 10 and one or several envelopes slide on top of platform 11 into the machine. The first element is the nudger 12 which comes down onto the top of the envelope or envelopes, and urges them forward against the contact point between the retard pad 14 and the feeder roll 13, which will stop all but the uppermost. This selected envelope then slides along the baffle 15 to the nip between the first set of driver rolls 16, 17.

In case regular paper is being used, sheets are supplied from rolls 36, 37 through baffle 39 to the same first set of driver rolls 16, 17.

These will drive the envelope until it contacts the stop 18, where a sensor detects the envelope's presence and stops the driver rolls 16, 17. At the same time the photoreceptor 19 is continuously rotating. When the photoreceptor is in the correct position, the stop 18 is removed from the path and the driver rolls 16, 17 drive the envelope through the nip between the next set of rolls 49, 20, past baffle 21 and into contact with the photoreceptor at the point 22 where the image is transferred from the photoreceptor to the envelope.

The next operation in the development of the image is the fusing of the toner to the paper at the fuser roll 23. In this printer, printing can be done on regular sheets of paper as well as envelopes, and that printing shall be allowed over the entire area of the sheet, and to all of the edges of the paper. In order to accomplish this, nothing must touch the toner side of the paper between the transfer and fusing points. This movement is accomplished by the vacuum transport assembly 24 which comprises two belts 25, shown here in an end view, driven by the two end rolls 26, 27, which transports the paper from the photoreceptor 19 to the fuser 23 by only contacting the paper's bottom surface. In fact, the belt assembly 24 in this figure is shown in its "down" position, which is the position that it is positioned into for the clearing of a jam. For normal operation the assembly is rotated counterclockwise around roll 27 so that the upper surface of the vacuum transport assembly is at horizontal line 28.

As stated above, if an envelope is being printed, because of its smaller area, the vacuum transport will not provide reliable movement of the envelope. Therefore, an additional set of rollers is provided, shown in the figure as rolls 29, 30, 31 and 32. These rolls are positioned so that they contact the envelope at one narrow edge, and provide just enough drive so that, with the aid of the vacuum transport, the envelope will be positively transported to the fuser. Of course, with these rollers contacting the fuser side of the envelope, printing can not take place at that edge of the envelope. However, this edge is the one that usually takes the postage stamp and will therefore never have any printing on it.

On the other hand, when the printer is next used to print regular sheets, with the requirement that there be printing to the edges, and considering that the vacuum transport is sufficient, these rolls must be retracted from contact with the paper. This retraction is done in a downward direction so that the entire roller assembly is below the paper and the plane of the vacuum plate and belts.

When the leading edge of the envelope clears the end of the vacuum transport at roll 27 it is guided by baffle 34 into the fuser roll 23 and pressure roll 35 which fix the toner onto the paper. The paper is then guided by the final baffle 50 into the output rolls 51, 52.

Figure 2:
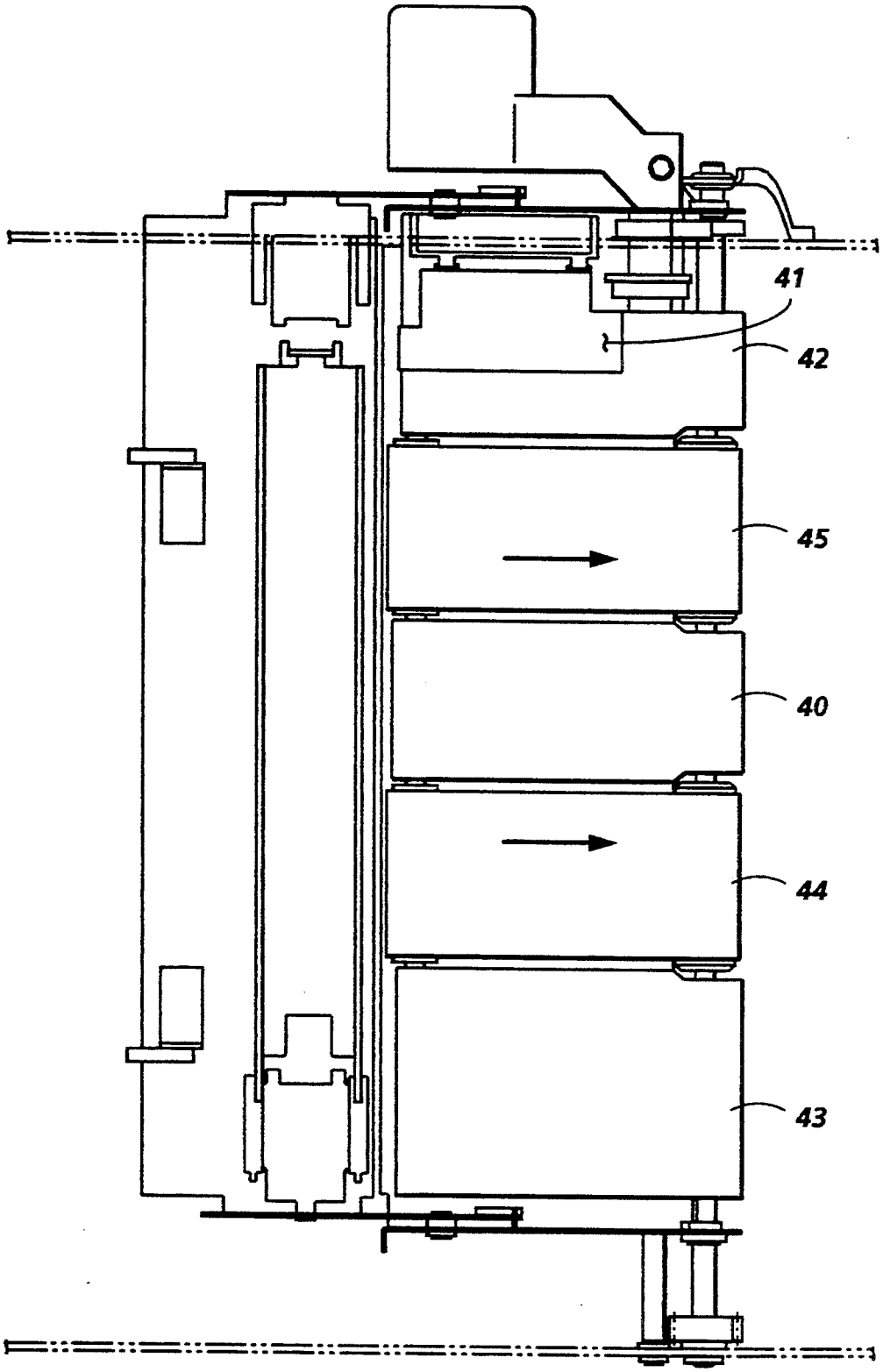
FIG. 2 is a top view of the vacuum transport.

FIG. 2 provides a top view of the assembly containing the additional rolls. As shown, for processing regular sheets of paper, this assembly contains three flat plates 42, 40 and 43 along which the paper slides in the direction indicated by the arrow. The paper is driven by the belts 44, 45 which have a large number of holes, not shown, to positively engage the paper by vacuum. Also, when used with sheet paper, the roller assembly is in its lowered position, so that a top plate, 41 is in the same plane as plate 42. For envelopes, the roll assembly, including plate 41 rises to engage its rolls with the envelope.

Figure 3:
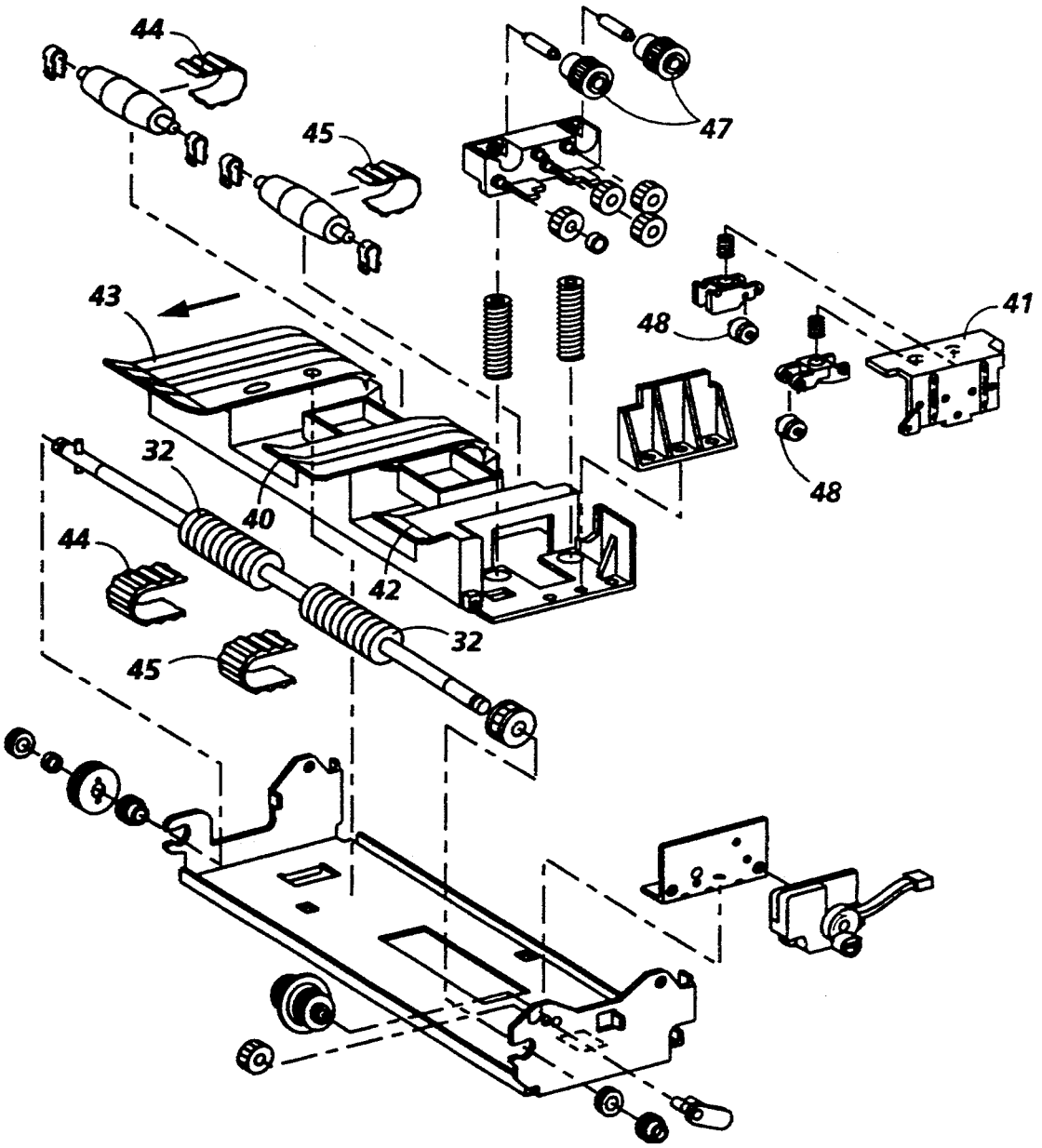
FIG. 3 is a blow-up of the additional rollers for use with envelopes.

The inner details of this additional roll assembly is shown in FIG. 3. The upper surface of the first belt 44 is between, and in the same plane as, plates 43 and 40; and the upper surface of the second belt 45 is between, and in the same plane as, plates 40 and 42. The belts are driven by rolls 32. In its upper position the side rollers 47 and the pinch rollers 48 come in contact with the envelope. In its lower position the top of the bracket 41 is in the same plane as plate 42.

Figure 4:
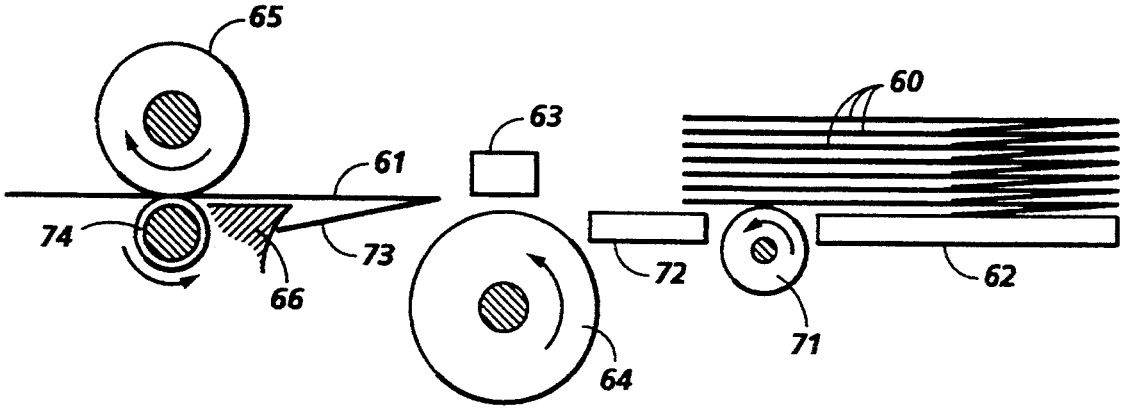
FIG. 4 is a block diagram of an envelope flap opener.

FIG. 4 is a block diagram of a flap opener which would typically be positioned just ahead of the printer. A stack 60 of envelopes is in contact with a baffle plate 62. When the next envelope is to be transported into the printer, the nudger 71 will move up into contact with the bottom envelope to urge one or several envelopes past guide 72 into contact with the retard pad 63. In coordination with the feeder roll 64, one envelope will be selected to go forward into the nip between rolls 65 and 74. At the same time the wedge 66 will insert itself between the body of the envelope 61 and the flap 73, thereby opening the flap. The envelope will then proceed through the system with the flap open.

While the invention has been described with reference to a specific embodiment, it will be understood by those skilled in the art that various changes may be made and equivalents may be substituted for elements thereof without departing from the true spirit and scope of the invention. In addition, many modifications may be made without departing from the essential teachings of the invention.

We claim:

1. A xerographic printer for printing on an envelope having a body and a flap, the inside surface of the flap having an area covered with a layer of glue, comprising:

transporter means for supplying the envelope into and through said printer bottom edge first, means for opening the flap of the envelope so that the flap and the body of the envelope are in the same plane, means for applying toner to said envelope, a fuser for fusing said toner to said envelope, and means for transporting the envelope past the means for applying toner and the fuser to apply and fuse toner to the body of the envelope and to the outside surface of said flap opposite that containing the layer of glue.

2. A method of using a xerographic printer to print on an envelope having a body and a flap, the inside surface of the flap having an area covered with a layer of glue, comprising the steps of:

opening the flap of the envelope so that the flap and the body of the envelope are in the same plane, supplying the envelope into and through said printer bottom edge first, applying toner to said envelope, fusing said toner to said envelope, and transporting the envelope past the means for applying toner and the fuser to apply and fuse toner to the body of the envelope and to the outside surface of said flap opposite that containing the layer of glue.

* * * * *